US008763182B2

(12) United States Patent
Schambon

(10) Patent No.: US 8,763,182 B2
(45) Date of Patent: Jul. 1, 2014

(54) PORTABLE DIAPER CHANGING SYSTEM

(71) Applicant: Amanda N. Schambon, Blue Bell, PA (US)

(72) Inventor: Amanda N. Schambon, Blue Bell, PA (US)

( * ) Notice: Subject to any disclaimer, the term of this patent is extended or adjusted under 35 U.S.C. 154(b) by 6 days.

(21) Appl. No.: 13/669,943

(22) Filed: Nov. 6, 2012

(65) Prior Publication Data

US 2014/0123395 A1 May 8, 2014

(51) Int. Cl.
*A47C 20/02* (2006.01)

(52) U.S. Cl.
USPC ..... 5/655; 5/632; 5/420; 5/417; 5/494

(58) Field of Classification Search
USPC ..... 5/655, 417, 420, 494, 632; 2/111, 304, 2/309, 311, 312
See application file for complete search history.

(56) References Cited

U.S. PATENT DOCUMENTS 4,989,286 A * 2/1991 Tucker ..... 5/482
6,298,509 B1 * 10/2001 Vickers ..... 5/655
6,981,289 B2 * 1/2006 Mueller et al. ..... 5/655
7,761,944 B2 * 7/2010 Skophammer ..... 5/655
8,037,561 B2 * 10/2011 Austwick et al. ..... 5/655
8,245,338 B1 * 8/2012 Nemeth ..... 5/655
2007/0089646 A1 * 4/2007 Duncan ..... 108/43
2011/0154573 A1 * 6/2011 Hinderliter, II ..... 5/655
2011/0314608 A1 * 12/2011 Rovin ..... 5/655

* cited by examiner

*Primary Examiner* — William Kelleher
*Assistant Examiner* — Duoni Pan
(74) *Attorney, Agent, or Firm* — Stuart M. Goldstein

(57) ABSTRACT

A diaper changing system utilizes a diaper holder member on which a diaper is to be positioned. Flaps extend outward from the holder member and are foldable over the diaper to maintain it in position on the holder member. The system also includes a unique baby supporting pad configured to be placed on the user's lap. The supporting pad can be utilized to maintain a diaper or in combination with the holder member supporting the diaper. A strap circumscribes the leg of the user to maintain the holder member and supporting pad on the user's leg. Once the supporting pad and/or the holding member, with diaper attached, is secured on the user's leg, the baby is placed on the diaper. The diaper is then wrapped around the baby and secured. The baby is removed from the system's components, which are then folded and compacted for storage and transport.

9 Claims, 7 Drawing Sheets

PORTABLE DIAPER CHANGING SYSTEM

BACKGROUND OF THE INVENTION

Parents with diaper wearing babies have long faced the challenge of changing their children's diapers in locations in which a changing table or readily accessible, elevated surface is not available. Such challenges especially arise when parents with children are traveling or are away from home at a public place such as a shopping mall, restaurant, office, etc. These situations are commonly addressed by the use of various portable child support pads and cushions. However, such products rely on the presence of a suitable surface on which they and the child must be placed. Often times this surface is the ground or floor, certainly not the most sanitary location and one which also results in physical discomfort for the squatting or kneeling diaper changer herself or himself. In addition, most of these pad and cushion diaper changing products do not have adequate means to secure a squirming baby while a diaper is being applied. While such products are designed to be folded, rolled, or otherwise reduced in size for transport, many are still bulky and do not easily fit into diaper bags or carrying cases.

Further, the manner in which the diapers of newly born infants are changed can be different from how the diapers of older babies are changed. However, there is currently no single portable diaper changing system specifically adapted to accommodate the particular diaper changing requirements of babies as they grow.

SUMMARY OF THE INVENTION

It is thus the object of the present invention to provide a diaper changing system which overcomes the disadvantages and limitations of prior diaper changing systems.

It is the object of the present invention to provide a diaper changing system which comprises separable, easily stored and portable components, which can be utilized individually or in combination, to change a baby's diaper in a safe and sanitary manner.

It is another object of the present invention to provide a diaper changing system which comprises an integral, unitary, lightweight diaper holding member and a uniquely designed baby supporting pad, both of which are readily compacted for easy storage and portability.

It is a further object of the present invention to provide a diaper changing system which is quickly and easily secured to the leg of the diaper changing user, allowing the baby to be placed on the user's lap and/or leg while the baby's diaper is being changed.

It is still another object of the present invention to provide a diaper changing system which can be utilized in virtually any location where there is seating available for the user who is changing the diaper.

It is a further object of the present invention to provide a diaper changing system which is versatile in that it is specifically adapted to be used for diapered babies of any age, beginning with newborn infants.

These and other objects are accomplished by the present invention, a diaper changing system comprising a diaper holder member on which a diaper is to be positioned. Flaps extend outward from the diaper holder member and are configured to be foldable over the diaper to maintain it in position on the diaper holder member. The system also includes a uniquely designed baby supporting pad configured to be placed on the lap of the user. The supporting pad can be utilized to maintain a diaper or in combination with the diaper holder member supporting the diaper. A strap is provided to circumscribe the leg of the user to maintain the diaper holder member and supporting pad on the user's leg. Once the supporting pad and/or the diaper holding member, with diaper attached thereto, is secured on the user's leg, the baby is placed on the diaper. The diaper is then wrapped around the baby and secured. The baby is removed from the system's components, which are then folded and compacted for storage and transport.

The novel features which are considered as characteristic of the invention are set forth in particular in the appended claims. The invention, itself, however, both as to its design, construction and use, together with additional features and advantages thereof, are best understood upon review of the following detailed description with reference to the accompanying drawings.

DETAILED DESCRIPTION OF THE INVENTION

The portable diaper changing system of the present invention comprises baby diaper holding member 1, baby supporting pad 100, and separable strap member 200.

Figure 1:
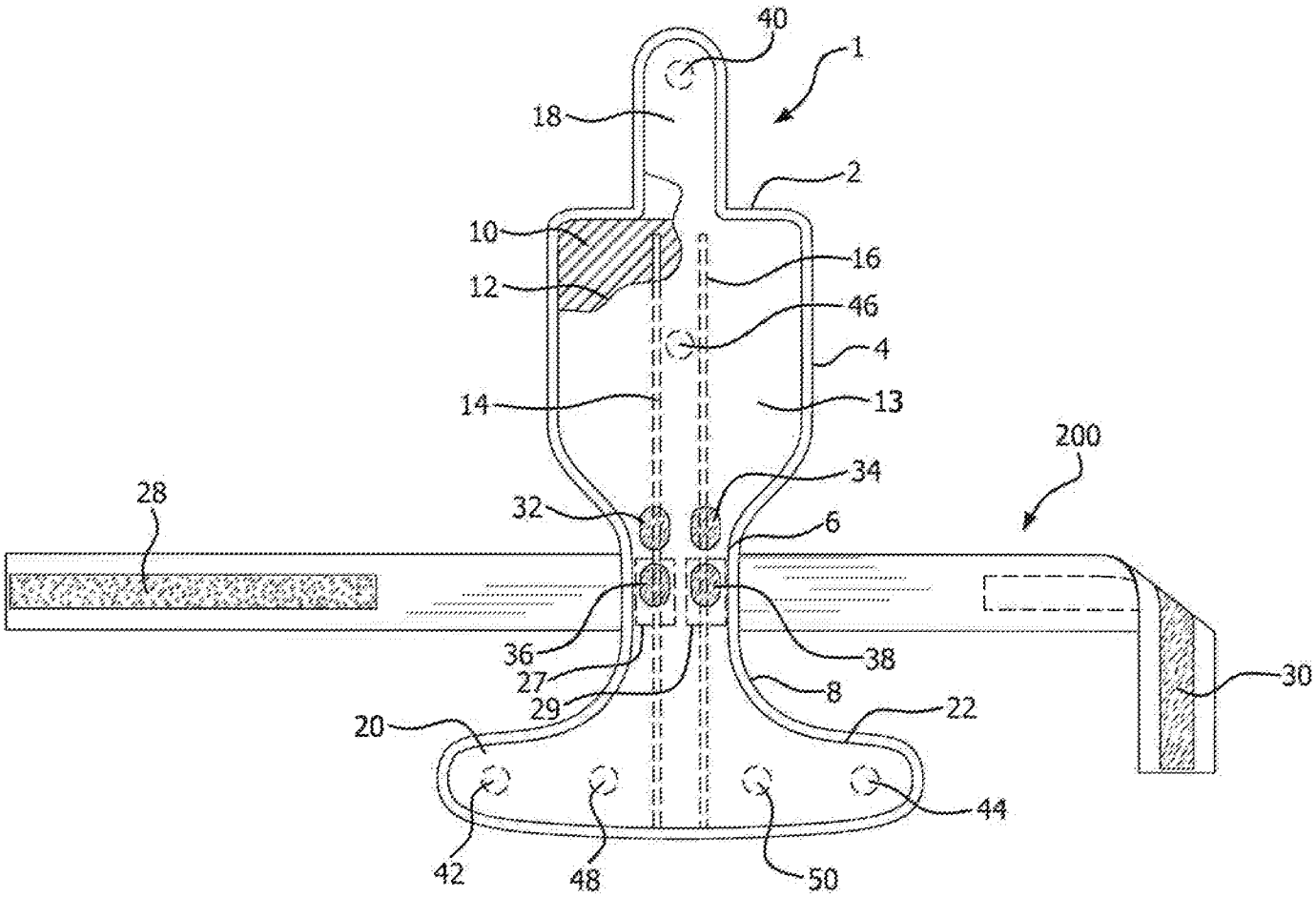
FIG. 1 is a top side plan view, partially broken away, of the diaper holder member of the portable diaper changing system of the present invention, with the removeable strap of the system positioned underneath the diaper holder member.
Figure 2:
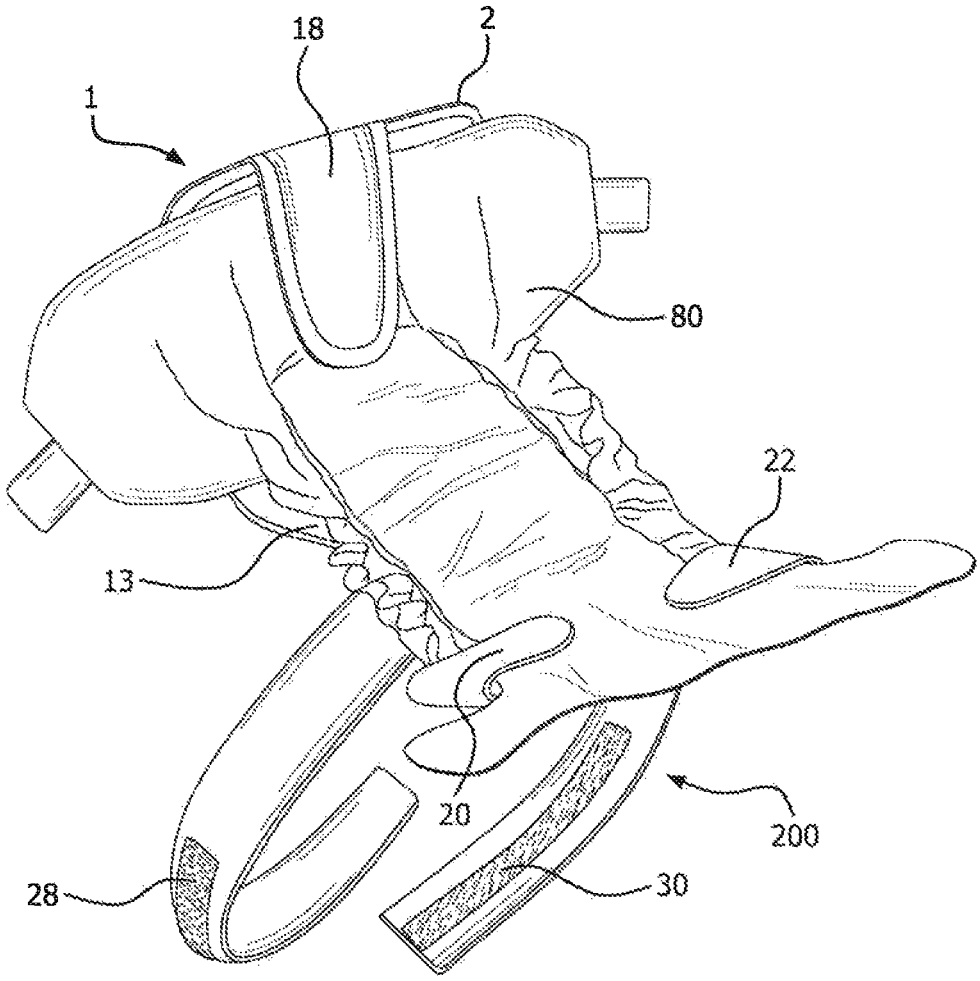
FIG. 2 is an isometric view of the diaper holder member of the portable diaper changing system of the present invention with a diaper positioned and secured therein and the removeable strap of the system secured underneath the diaper holding member.
Figure 3:
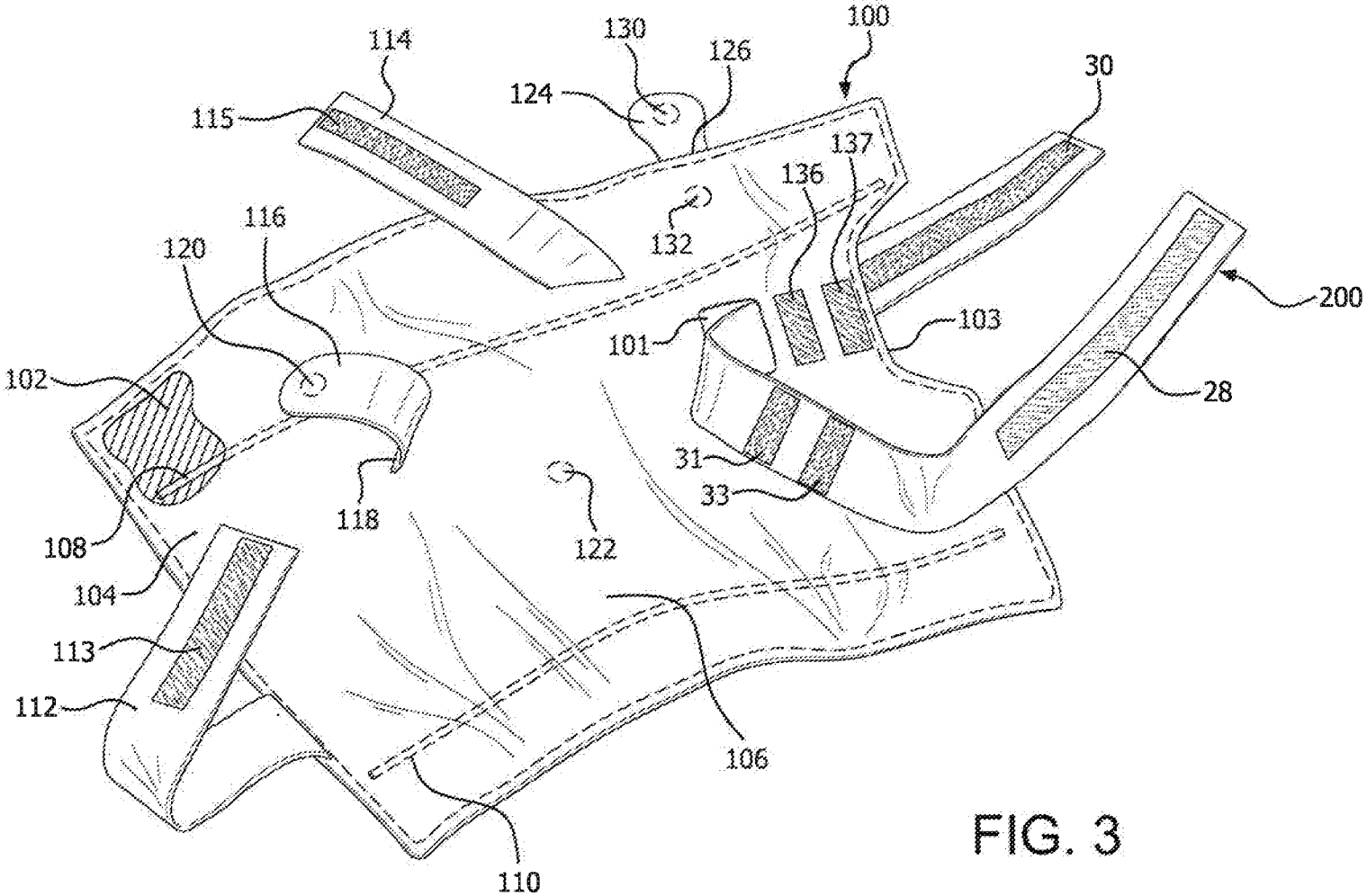
FIG. 3 is a top side plan view, partially broken away, of the baby supporting pad of the portable diaper changing system of the present invention, with the removable strap of the system extending through the supporting pad.

Diaper holding member 1 comprises baby supporting member 2 having rear section 4, intermediate section 6, and forward section 8. FIG. 1 is a view of the system, fully laid out, showing its top side. Baby supporting member 2 is a unitary, integral member comprising a lightweight, easily bendable core 10, e.g. plastic, aluminum, or equivalent, which is totally enclosed, both top side and back side, within a durable, lightweight, waterproof, flexible material 12. The top side surface of material 12 is the diaper supporting surface 13 of baby supporting member 2. Rear flap 18 and forward flaps 20 and 22 extend from baby supporting member 2. Flexible, lightweight, bendable metal rods 14 and 16 are positioned and secured between core 10 and material 12 of baby supporting member 2, as seen in FIG. 1. Rods 14 and 16 extend almost the full length of the baby supporting member. This construction of baby supporting member 2 permits its rear section 4, intermediate section 6, and forward section 8 to be bendably adjusted to conform with the child whose diaper is to be changed. A bended configuration of diaper changing holding member 1 is depicted in FIG. 2.

Velcro® or equivalent connection pieces 32, 34, 36, and 38 are located on diaper supporting surface 13 of baby supporting member 2. Magnets 46, 48, and 50 are positioned and secured between core 10 and material 12 of baby supporting member 2. Magnet 40 is positioned and secured within flap 18, between the top side and back side of material 12. Magnets 42 and 44 are positioned and secured within flaps 20 and 22, respectively, between the top side and back side of material 12.

Strap 200 is a separable component configured to be positioned, adhered to, and secured beneath intermediate section 6 of baby supporting member 2, by means of Velcro® connectors 31 and 33 on the strap and Velcro® connectors 27 and 29 on diaper holding member 1, in order to secure the strap to the diaper holding member when the diaper holding member is to be used without supporting pad 100, as described hereinafter. Velcro® connectors 28 and 30 are secured at the ends of strap 200.

Baby supporting pad 100 is a unitary, integral, member having substantially the length of the lap of an average, seated user. Like diaper holding member 1, supporting pad 100 comprises a lightweight, easily bendable core 102, e.g. plastic, aluminum or equivalent, which is totally enclosed, both the top side and the lower side, within a durable lightweight, waterproof, flexible material 104. Consequently, the material utilized in supporting pad 100 results in the pad being stronger and thus having increased weight bearing capacity than baby pads currently available. Most prior pads are constructed only of fabric and, as a result, are flimsy and cannot support a baby's weight.

The top surface of supporting pad 100 is the diaper and baby supporting surface 106 of the supporting pad. Flexible, lightweight, bendable rods 108 and 110, positioned and secured between core 102 and material 104, extend almost the full length of supporting pad 100. This construction of the supporting pad permits it to be folded up for transport and storage and unfolded and spread out for use. Opening 101 extends through supporting pad 100. Lateral cutout area 103 is located on one side of the supporting pad.

Supporting pad 100 comprises straps 112 and 114 having Velcro® or equivalent interlocking connections 113 and 115 at their ends. Straps 112 and 114 serve to immovably maintain a baby positioned on supporting pad 100.

Supporting pad 100 also comprises flap 116, secured at one end 118 to surface 106. Magnet 120, embedded in the other end of flap 116, is configured to be attracted and attached to magnet 122 embedded in supporting pad 100. Flap 116 is pivotable at its end 118 between a lifted position when rotated up off surface 106, to a lowered position in order to maintain a diaper resting on supporting pad 100 between the supporting pad and the flap.

Smaller flap 124 is secured at one end 126 to supporting pad 100. As described with regard to flap 116, magnets 130 and 132 are embedded in the other end of flap 124 and in supporting pad 100. Flap 124 is pivotable at its end 126 between a lifted position when rotated up off surface 106, to a lowered position in order to maintain cleaning wipes or equivalent cleaning elements 134 resting on supporting pad 100 between the supporting pad and the flap. See FIG. 4.

Velcro® or equivalent connectors 136 and 137 are permanently attached to surface 106 of supporting pad 100, between opening 101 and cutout area 103.

Figure 4:
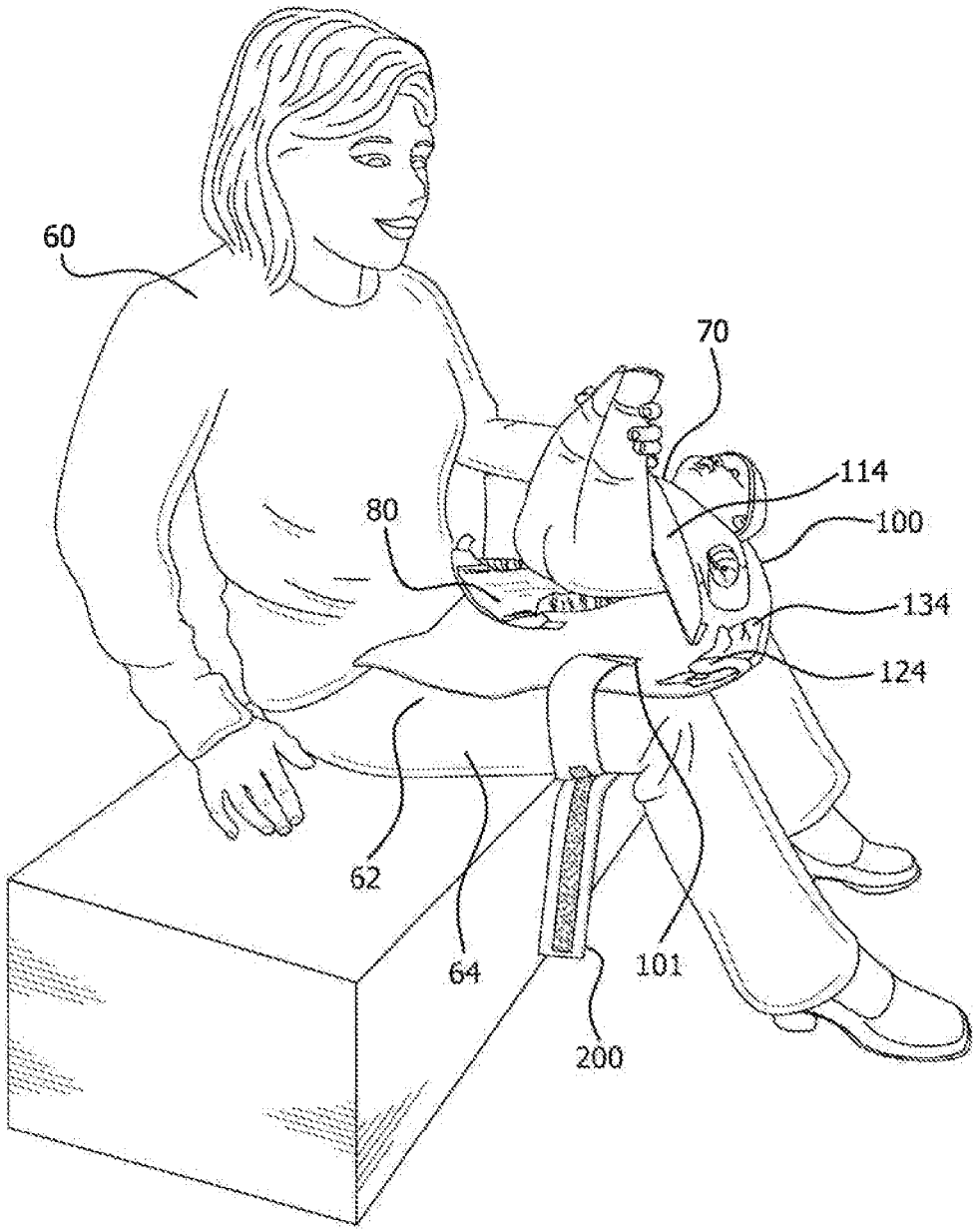
FIG. 4 shows the manner of changing an infant's diaper solely utilizing the supporting pad and strap of the portable diaper changing system of the present invention.

It is contemplated that the portable diaper changing system of the present invention will initially be used for infant babies, newborn to approximately six months. As seen in FIG. 4, supporting pad 100 is placed on lap 62 of user 60. Strap 200 is inserted into opening 101 and wrapped around and secured to user's leg 64 by means of Velcro® connectors 28 and 30. Diaper 80 is placed on and secured on supporting pad 100 by flap 116. Infant baby 70 is positioned on supporting pad 100 and immovably maintained in this position by overlaying and attaching straps 112 and 114 over the child. Cleaning wipes, tissues, or other cleaning elements 134, are positioned on supporting pad 100 and held in place by flap 124.

After baby 70 is cleaned with wipes 134, diaper 80 is secured on the child and flap 116 is removed from the diaper. The user removes baby 70, with secured diaper 80, from supporting pad 100 to a safe location. Strap 200 is then detached and, along with supporting pad 100, is removed from around leg 64 and lap 62 of user 60. Supporting pad 100 can then be compactly folded for transport or storage.

Figure 5:
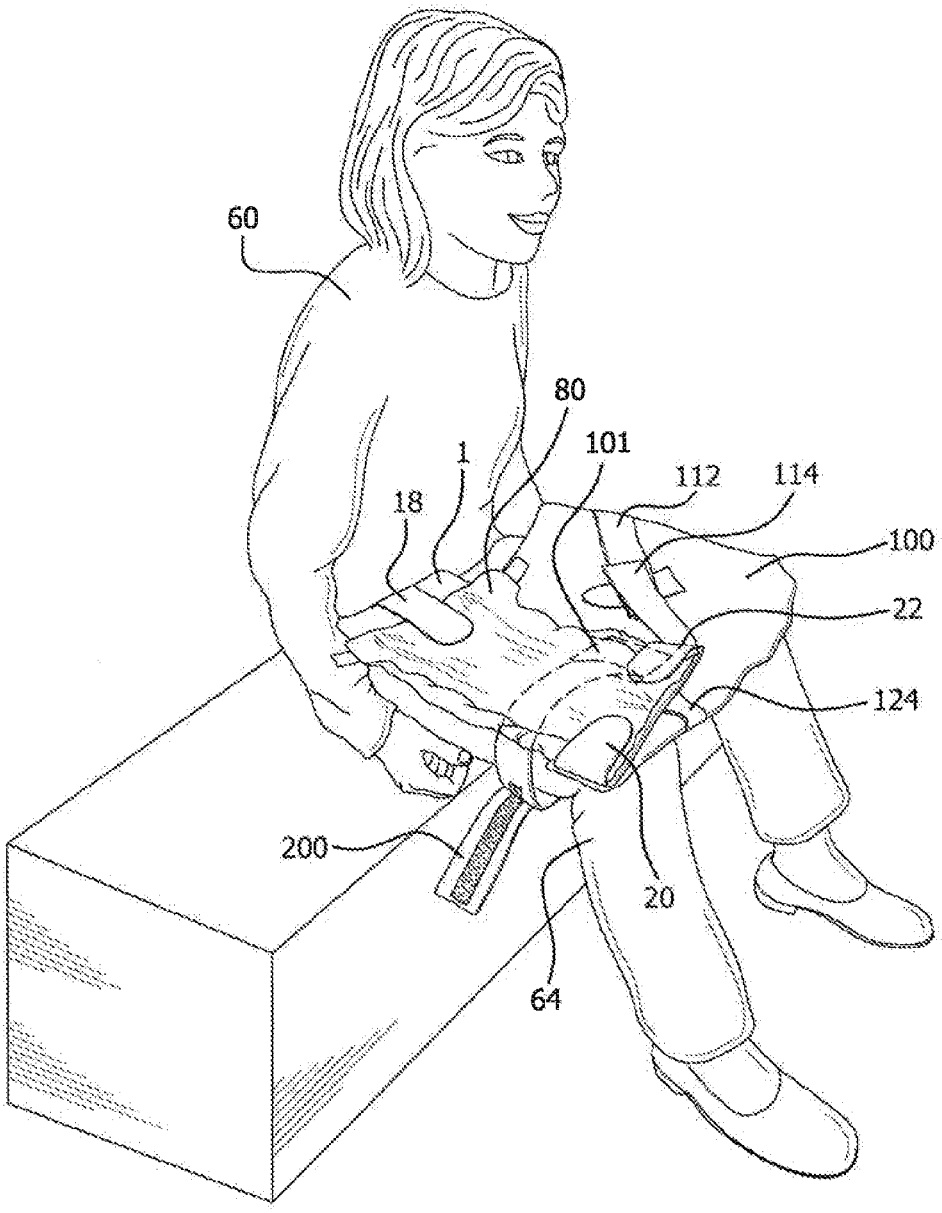
FIG. 5 shows an initial step in changing a baby's diaper using the supporting pad, the diaper holder member, and strap of the portable diaper changing system of the present invention.
Figure 6:
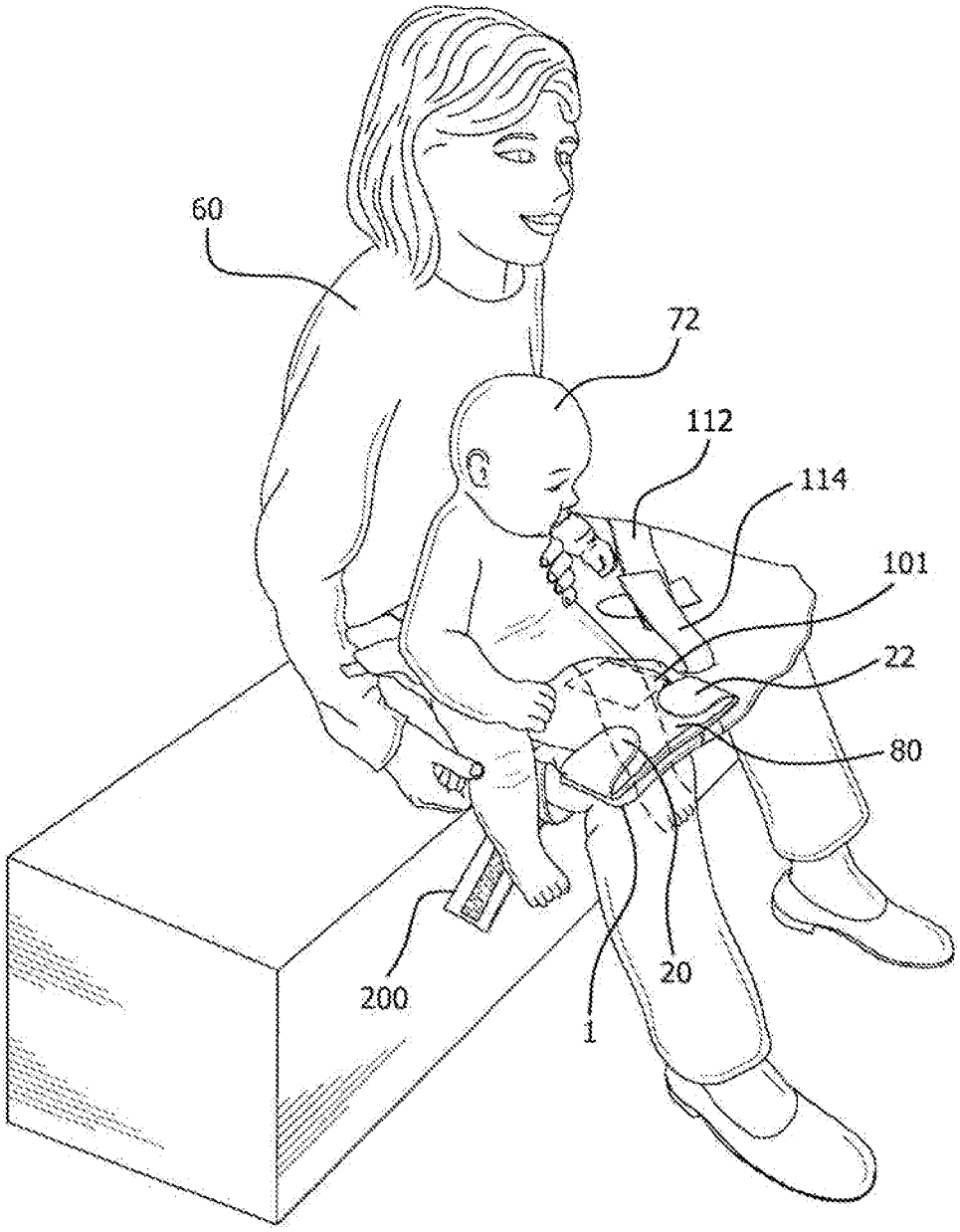
FIG. 6 shows the manner of use of the portable diaper changing system of the present invention, following the step shown in FIG. 5.

Babies aged approximately six months to nine months or one year can sit somewhat upright. For these children, the portable diaper changing system is used as follows, and is depicted in FIGS. 5 and 6. Diaper holding member 1 is attached to supporting pad 100 by means of Velcro® connectors 136 and 137 on surface 106 of the pad and corresponding Velcro® connectors 27 and 29 on the bottom of the diaper holding member. Supporting pad 100 is then positioned on user's lap 62. Strap 200 is inserted into opening 101 and wrapped around and secured to leg 64 of user 60 as previously discussed. For this diaper changing procedure, strap 200 should be positioned over diaper holding member 1 such that Velcro® connectors 31 and 33 on the strap are face-up, with the strap and these connectors being located over Velcro®connection pieces 32, 34, 36 and 38 of the diaper holding member. Diaper 80 is then appropriately positioned on diaper supporting surface 13 of diaper holding member 1. A combination of Velcro® pieces 32, 34, 36, and 38 on diaper supporting surface 13 of diaper holding member 1 and Velcro® connectors 31 and 33 on strap 200 adhere to the underside of diaper 80, thus providing a first means of attaching the diaper to diaper holding member system 1.

Diaper 80 is then securely maintained on diaper holding member 2 by means of flaps 18, 20, and 22, which are folded such that they overlay the diaper. When the flaps are folded onto diaper 80, magnet 40 in flap 18 is attracted to magnet 46 in rear section 4, magnet 42 in flap 20 is attracted to magnet 48 in forward section 8, and magnet 44 in flap 22 is attracted to magnet 50 in the forward section. Despite the fact that diaper 80 is located between magnets 40 and 46, 42 and 48, and 44 and 50, it is contemplated that the magnets will have sufficient magnetic attractive force to securely maintain the diaper between flaps 18, 20, and 22 and diaper supporting surface 13.

Baby 72 is then positioned and immovably secured on supporting pad 100 by straps 112 and 114 and is cleaned, as previously described. After cleansing baby 72, straps 112 and 114 are removed and the baby is held in an upright position, over and then on diaper 80, with one leg extending down, adjacent to lateral cut out area 103 and the other leg extending through opening 101 in supporting pad 100. See FIG. 6. Flaps 18, 20, and 22 are unfolded and diaper 80 wrapped and secured around baby 72. After baby 72 is placed in a safe location, diaper holder member 1 is detached from supporting pad 100 and, as discussed previously, strap 200 is removed, along with the supporting pad, from the leg and lap of the user. Both supporting pad 100 and diaper holder member 1 can be neatly and compactly folded and stored.

Figure 7:
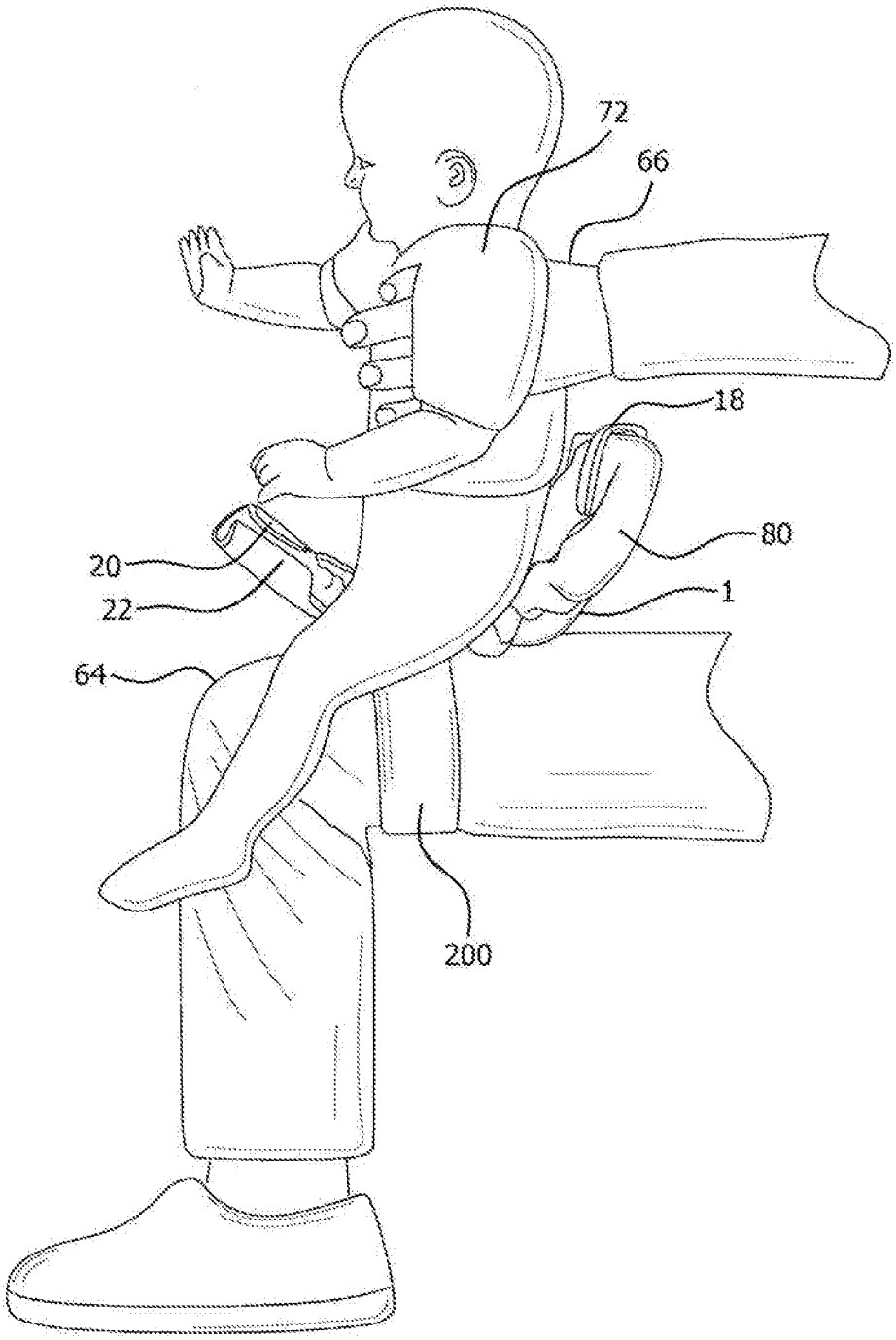
FIG. 7 shows the manner of use of the portable diaper changing system of the present invention utilizing the diaper holder member and strap in changing the diaper of a baby.

For babies who are fully capable of maintaining an upright position or when supporting pad 100 is not otherwise needed or is unavailable, diaper holder member 1 can be used without the supporting pad. Diaper 80 is first positioned and secured on diaper holder member 1 by means of flaps 18, 20 and 22, as previously described. As shown in FIG. 7, strap 200 is wrapped around leg 64 of user 60 and the strap is secured in this position on the leg by means of Velcro® connectors 28 and 30. Strap 200 is again secured to user's leg 64 with Velcro® connectors 31 and 33 facing up. Diaper holder member 1, with diaper 80 secured thereto, is then attached to Velcro® strap connectors 31 and 33 by means of Velcro® connectors 27 and 29 on the bottom of the diaper holder member. Baby 72 is then positioned on diaper 80, as seen in FIG. 7. User's hand 66 is used to support baby 72 and prevent him or her from squirming. Flaps 18, 20, and 22 are unfolded and the diaper wrapped and secured around the baby. Once the diapering operation is completed, user 60 removes baby 72 with secured diaper 80 from diaper holding member 1 to a safe location. Strap 200 is removed from user's leg 64 and detached from diaper holding member 1. The diaper holding member can then be neatly and compactly folded and stored for later use, along with strap 200.

The diaper changing system of the present invention is one which permits babies of all ages to have their diapers changed safely and easily, in a sanitary manner, regardless of location. The system comprises three basic lightweight components which are simply folded and stored and thus are very portable.

Certain novel features and components of this invention are disclosed in detail in order to make the invention clear in at least one form thereof. However, it is to be clearly understood that the invention as disclosed is not necessarily limited to the exact form and details as disclosed, since it is apparent that various modifications and changes may be made without departing from the spirit of the invention.

The invention claimed is:

1. A portable diaper changing system for the lap of the user comprising:

a baby supporting pad of sufficient length such that it extends substantially across the entire lap of a user, the pad having a top surface and an opening extending through the top surface and completely through the pad;

flap means located on the supporting pad for securing a diaper on the supporting pad, said flap means having two ends, only one end being secured to the pad, the flap means being pivotable between a raised position when rotated off the pad to a lowered position on the pad for securing the diaper between the ends of the flap means;

strap means secured to the pad for overlaying and immovably maintaining a baby on the supporting pad, said strap means comprising two separate, independent strap sections attached to and extending up from the pad, each strap section having connection means for securing the strap means over a baby; and leg attachment means extending through the opening in the pad for circumscribing a single leg of a user, thereby securing the pad to said leg of the user.

2. The portable diaper changing system as in claim 1 wherein the leg attachment means comprises a separate, independent, removeable strap member.

3. The portable diaper changing system as in claim 2 wherein the opening is located and sized within the pad to receive the strap member circumscribed around said single leg of the user and also to allow the insertion of a leg of a baby receiving a diaper change on the pad.

4. The portable diaper changing system as in claim 1 further comprising means for maintaining the diaper between the flap means and the supporting pad.

5. The portable diaper changing system as in claim 1 further comprising connection means on the supporting pad for adhering to and maintaining an independent, separable diaper holding member, whereby the diaper changing system permits the changing of a baby's diaper solely on the diaper holding member, separate and apart from the pad, and also the changing of a baby's diaper on the diaper holding member, with the diaper holding member adhered to and maintained on the supporting pad by the connection means.

6. The portable diaper changing system as in claim 5 wherein the diaper holding member comprises a baby supporting member having a forward section, an intermediate section, and a rear section, first means extending from the rear section for securing a diaper to the baby supporting member, and second means extending from the forward section for securing a diaper to the baby supporting member.

7. The portable diaper changing system as in claim 6 further comprising second connection means on the diaper holding member for attachment with the connection means on the supporting pad to adhere to and maintain the diaper holding member on the supporting pad.

8. The portable diaper changing system as in claim 1 wherein the supporting pad comprises a lateral cut-out, the cut-out and opening accommodating the legs of a baby receiving a diaper change on the diaper changing system.

9. The portable diaper changing system as in claim 1 wherein the leg attachment means comprises a separate, independent, removeable, strap member, and said strap member comprises strap connection means for adhering to and maintaining the diaper holding member, and the diaper holding member comprises corresponding strap connection means for adhering to the strap connection means, whereby when the baby's diaper is changed solely on the diaper holding member, the strap member extends around the leg of the user and the diaper holding member is attached and secured to the strap member.

* * * * *